US008646590B2

(12) United States Patent
Tepel

(10) Patent No.: US 8,646,590 B2
(45) Date of Patent: Feb. 11, 2014

(54) REVOLUTION TRANSPORT SYSTEM FOR MANUFACTURING AND ASSEMBLY LINES

(75) Inventor: Herbert Tepel, Vöhl (DE)

(73) Assignee: Expresso Deutschland GmbH, Kassel (DE)

( * ) Notice: Subject to any disclaimer, the term of this patent is extended or adjusted under 35 U.S.C. 154(b) by 126 days.

(21) Appl. No.: 13/325,157

(22) Filed: Dec. 14, 2011

(65) Prior Publication Data

US 2012/0181146 A1 Jul. 19, 2012

(30) Foreign Application Priority Data

Dec. 15, 2010 (DE) ..... 20 2010 016 627 U

(51) Int. Cl.
*B65G 37/00* (2006.01)

(52) U.S. Cl.
USPC ..... 198/343.2; 198/346.2; 198/465.2; 198/800; 198/860.1

(58) Field of Classification Search
USPC ..... 198/343.2, 346.2, 346.3, 465.2, 797, 198/800, 860.1
See application file for complete search history.

(56) References Cited

U.S. PATENT DOCUMENTS

| | | | | | |
|---|---|---|---|---|---|
| 2,350,496 | A * | 6/1944 | Davis | 198/346.3 |
| 2,555,227 | A * | 5/1951 | King | 198/343.2 |
| 2,826,288 | A * | 3/1958 | Giaier | 134/76 |
| 3,152,679 | A * | 10/1964 | Lammert | 198/346.3 |
| 3,193,121 | A * | 7/1965 | Kumpf et al. | 198/346.3 |
| 4,051,969 | A * | 10/1977 | Homanick | 414/679 |
| 6,502,691 | B2 * | 1/2003 | Akatsuka et al. | 198/795 |
| 6,688,451 | B2 * | 2/2004 | Derby et al. | 198/346.1 |
| 6,889,816 | B2 * | 5/2005 | Willing | 198/465.2 |
| 7,648,018 | B2 * | 1/2010 | Inui | 198/463.3 |
| 2010/0170412 | A1 * | 7/2010 | Robinson et al. | 104/93 |

* cited by examiner

*Primary Examiner* — Gene Crawford
*Assistant Examiner* — Keith R Campbell
(74) *Attorney, Agent, or Firm* — Klaus J. Bach

(57) ABSTRACT

In a revolution transport system for manufacturing and assembly lines with work stations arranged along the transport system, workpiece carriers are movably supported on a track formed by horizontally spaced outer and inner carrier and support rails extending around the transport system wherein each workpiece carrier includes a carriage movably supported on the outer rail and upper and lower rollers in engagement with upwardly facing and downwardly fairing surfaces of the intermediate or inner rail to prevent tilting of the workpiece carrier by forces acting on an outwardly projecting workpiece support arm of the workpiece carrier.

10 Claims, 3 Drawing Sheets

REVOLUTION TRANSPORT SYSTEM FOR MANUFACTURING AND ASSEMBLY LINES

BACKGROUND OF THE INVENTION

The invention resides in a revolution transport system for manufacturing and assembly lines for transporting workpieces between several work stations arranged along the transport system.

Such revolution transport systems are used if workpieces need to be machined at several subsequent workstations or if subassemblies or components need to be assembled at subsequent assembly stations in a continuous manner.

Herein the workpieces or components are moved on workpiece carriers from work station to work station along the transport system wherein at a start station a workpiece or component is disposed on the workpiece carrier and, after passing through the subsequent workstations, is again removed from the workpiece carrier at an end station. The workpiece carrier is then moved along the revolution transport system back to the start station.

Such a revolution transport system includes a transport frame which, with support and guide rails forms a transport path along which the workpiece carriers are movable which may be in the form of carriages or similar.

In known revolution transport systems of this type, the support and guide rails are arranged vertically and the workpiece carriers are vertically supported thereon. This however results in a large construction height and a need for a relatively large space.

It is the object of the present invention to provide a revolution transport system of the type described which however has lower space requirements and, in particular, a lower construction height and which, with regard to design and expansion can easily be manufactured economically in various sizes and with various track or rail lengths.

SUMMARY OF THE INVENTION

In a revolution transport system for manufacturing and assembly lines with work stations arranged along the transport system, workpiece carriers are movably supported on a track formed by horizontally spaced outer and inner carrier and support rails extending around the transport system wherein each workpiece carrier includes a carriage movably supported on the outer rail and upper and lower rollers in engagement with upwardly facing and downwardly fairing surfaces of the intermediate or inner rail to prevent tilting of the workpiece carrier by forces acting on an outwardly projecting workpiece support arm of the workpiece carrier.

The advantages over conventional revolution transport systems are a low height of the transport frame structure which, in comparison with conventional transport systems with vertical support structures for the workpiece carriers movably supported on the support structures, is of very flat design. The invention facilitates also a design of a support frame that requires a relatively small use of materials and provides for a very good moment accommodation as a result of a large support lever arm.

Furthermore, the revolution transport system has the advantage that it is of modular design by the provision of two reversing end sections with intermediate center sections the number of which is variable.

Below, a preferred exemplary embodiment of the invention will be described in detail with reference to the accompanying drawings.

DESCRIPTION OF A PARTICULAR EMBODIMENT

Figure 1:
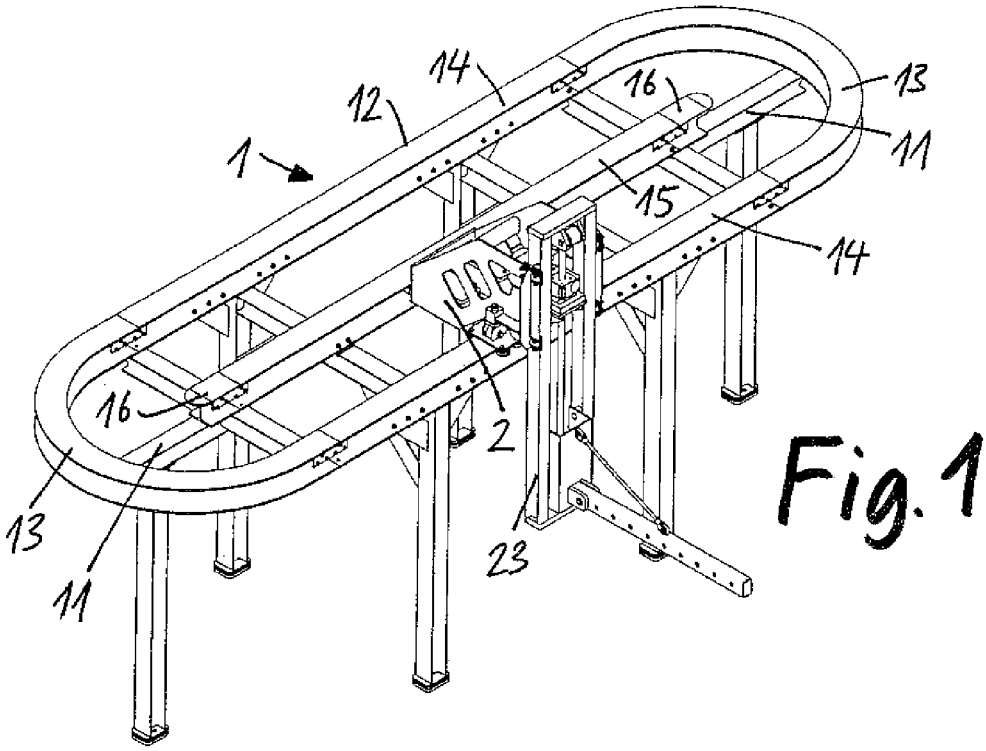
FIG. 1 is a perspective view of a revolution transport system according to the invention provided with an exemplary tool carrier.
Figure 2:
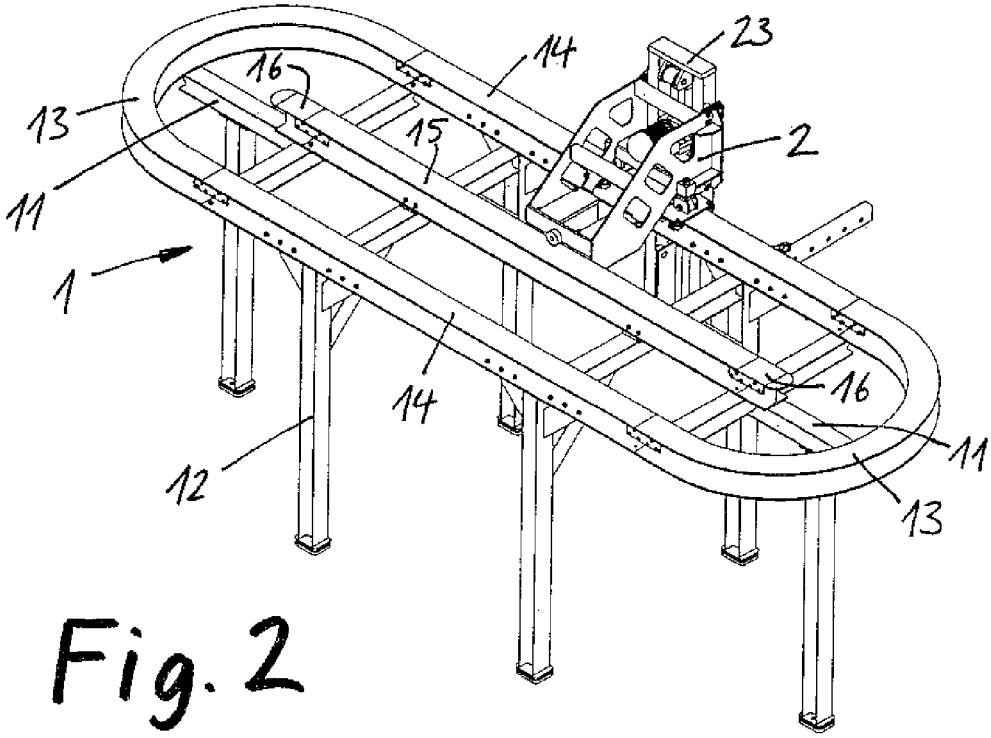
FIG. 2 is a perspective view similar to FIG. 1 but viewed from another direction.
Figure 3:
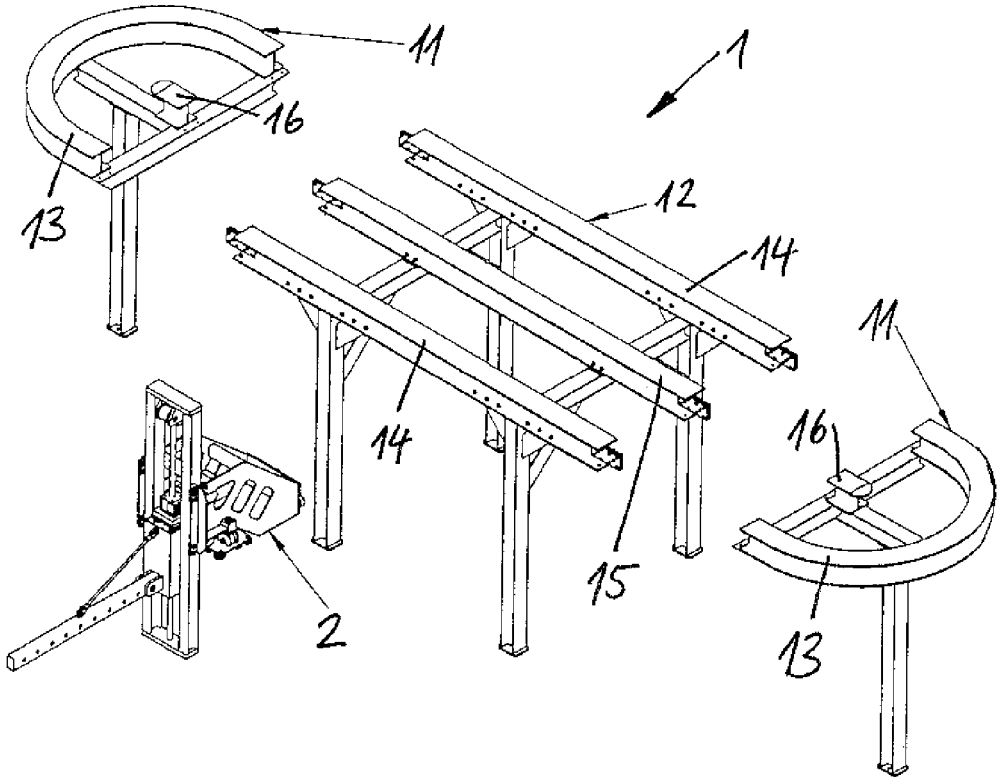
FIG. 3 is a perspective view of the components of the revolution transport system of FIGS. 1 and 2 with the components separated from one another.

As shown in FIGS. 1 to 3, the revolution transport system according to the invention comprises a transport frame 1 and a workpiece carrier 2 which is movably supported on the frame 1 but of which only one is shown. FIGS. 1 and 2 show the assembled revolution transport system in perspective views as seen from two different angles, and FIG. 3 shows the arrangement according to FIGS. 1 and 2 with the frame components pulled apart.

As shown in FIG. 3, the transport frame 1 comprises two end sections 11 each of which forms a reversing section of the transport track, and center components 12 of which only one is shown in FIGS. 1-3 in order to avoid the need for showing an excessive length and to permit representation of the whole system in one drawing. It should be obvious that any number of center components 12 may be provided depending on the desired length of the revolution transport system. The length depends mainly on the number of workstations that are to be arranged along the transport system. The revolution path is formed by tracks 13, 14, 15 and 16 which are part of the transport frame. They comprise at the two end sections 11 in each case a semicircular support and guide structure which forms the reversing arc of the revolution transport track.

The, or each, section 12 of the transport frame has at both sides two outer support and guide rails 14 which (with the use of only one center section 12) forms the preferably straight line revolution path section which interconnects the reversing rail sections 13 connected to the ends of the straight line center section 12.

The intermediate or inner rail 15 of the, or each, center section 12 serves as a support rail. Each outer support and guide rail 14 and the inner support rail 15 form together in each case two horizontally spaced support and guide tracks of which one rail that is the support and guide rail 14 is disposed with respect to revolution track of the revolution transport system on the outside and the other rail, that is, the intermediate or inner rail 15 is arranged in the center.

In the exemplary embodiment which forms the preferred embodiment, the single intermediate rail 15 forms the inner support rail for the outer support and guide rail 14 at one side of the center section as well as for the other outer support and guide rail 14 at the other side of the center section 12.

Obviously, the arrangement described, while being particularly advantageous, does not represent the only possible embodiment of the invention. It is for example, possible to provide a pair of intermediate rails 15 whereby the end sections then would have not only an outer curved reversing rail but also an inner curved rail forming the reversing structure for connecting the ends of the two separate intermediate rails of the center section.

In the exemplary embodiment, the end sections 11 of the transport frame have as reversing structure only a short rounded head piece 16 which connects to the intermediate support rail 15 of the center section 12.

Figure 4:
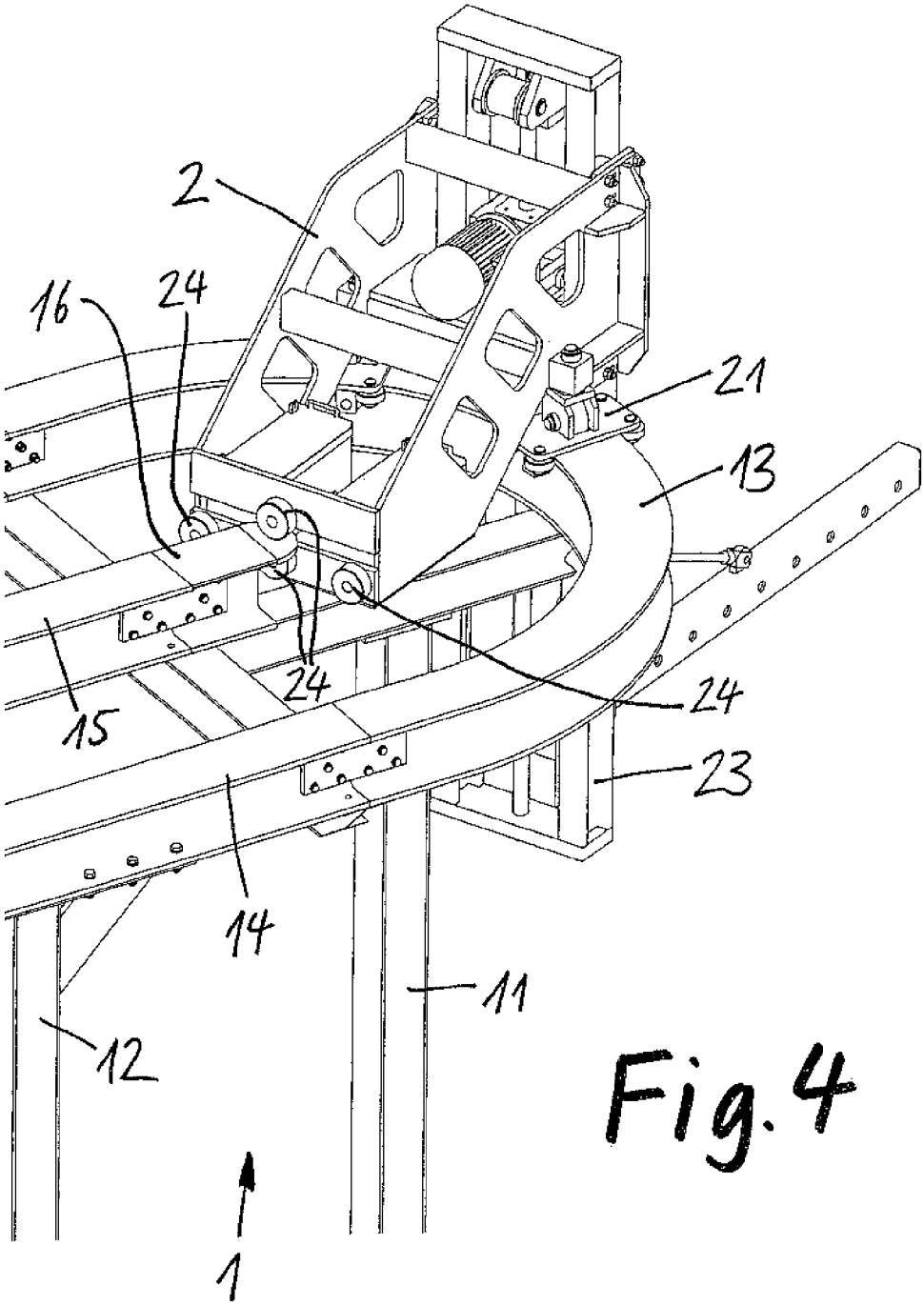
FIG. 4 shows the tool carrier upon passing a reversing end of the arrangement shown in FIGS. 1 to 3.

As shown in FIGS. 1, 2 and 4, the, or respectively each, workpiece carrier 2 is horizontally supported on the transport frame. Herein, the work piece carrier 2 is supported on the outer support and guide rail 14 or, respectively, 13 by means of two pivotable carrying units 21 which are movable along the rail. Instead of two carrying unit 21, another carrier design may be selected for guiding the workpiece carrier along the outer support and guide rail.

While the workpiece is arranged with respect to the revolution path at the outside of the workpiece carrier 2 where the workpiece carrier is preferably provided with a lifting structure 23, the inner end of the workpiece carrier 2 projecting toward the intermediate support rail 15, 16 is supported on the intermediate rail by means of support rollers 24, which cooperate with an upwardly facing support surface of the support rail 15, 16 as well as with a downwardly facing support surface of the support rail 15, 16. The support rail 15, 16 has to this end, an I- or a T-profile, wherein the upper horizontal web forms the upwardly facing as well as the downwardly facing support surface.

Preferably, all the rails of the transport frame, that is, the outer rails 14, 13 as well as the intermediate rail 15, 16 have the same I- or T-profile, that is, they consist of the same profile material which simplifies storage maintenance and material economics.

The arrangement of the support rollers 24 with respect to the revolution of the track on the inner end of the workpiece carrier 2 and their cooperation is apparent best from FIG. 4. FIG. 4 in this respect shows the workpiece carrier 2 as it is passing through a reversing section so that all four support rollers 24 provided at the intermediate rail 15, 16 are visible.

As shown the workpiece carrier 2 includes center support rollers 24 arranged at the intermediate rail of which one is disposed on top and one is disposed below for cooperation with the upwardly facing and, respectively, the downwardly facing support surface of the intermediate support rail 15, 16. Two additional rollers diposed at opposite sides of the two center support rollers 24 are arranged so as to abut the lower support surface of the intermediate support rail 15, 16. Upon passing through the reversing sections at the end section 11, where the intermediate rail 15, 16 is provided only with a rounded head area, only the two center support roller 24 of the workpiece carrier cooperate with the support rail while the other two support rollers 24 are pivoted away from the support rail 15, 16.

The support rollers 24 arranged at the inner end of the workpiece carrier 2 cooperate with the intermediate support rail 15, 16 for supporting the workpiece carrier to prevent tilting thereof as a result of a workpiece disposed on the outwardly projecting arm of the workpiece carrier 2. Since such a tilting moment tends to pivot the workpiece carrier 2—outwardly and away from the intermediate rail, such a pivot torque is compensated for by the support rollers 24 in contact with the downwardly facing support surface of the support rail 15, 16. Upon passing through a curved reversing section, the workpiece carrier 2 does not carry any workpiece if all the workstations are arranged along one side of the revolution transport system. But even if workstations are arranged at both sides and the workpiece carrier still carries a workpiece upon passing through the reversing section, a load by the tilting moment is smaller than at the workstations where machining and mounting forces may be effective in addition to the weight of the workpiece. When such additional forces are applied at the workstations all three lower support rollers 24 are in contact with the downwardly facing support surface of the intermediate rail 15, 16.

The workpiece carrier 2 may be provided with counter weights in its area disposed between the intermediate support rail and the outer support or guide rail to provide a counterweight to the moments generated by the workpiece and by forces possibly applied by machining units. As such counterweights components may be used which are needed anyway such as for example drive motors, drive gears, cylinders or batteries.

What is claimed is:

1. A revolution transport system for manufacturing and assembly lines for the transport of workpieces between several workstations arranged along the transport system, comprising: a transport frame (1) forming a revolution track with a number of workpiece carriers (2) movably supported on the revolution track, said revolution track being formed by two horizontally spaced support and guide rails (13, 14, 15, 16) of which one rail (13, 14) extends at the outside around the transport system and forms a carrier and guide rail and the other rail (15, 16) forms an inner support rail structure disposed between the carrier and guide rails, each workpiece carrier (2) being supported by a track-guided carriage (21) along the outer carrier and guide rail (13, 14) as well as the inner support rail structure (15, 16) by inner support rollers (24), the workpiece carrier (2) including workpiece support or lifting structures (23) which are disposed outside the outer carrier and guide rail (14, 13) for supporting a workpiece outside the outer carrier and guide rail (14, 13), the inner support rollers (24) cooperating with the inner support rail structure (15, 16) by engagement with upper as well as lower support surfaces of the inner support rail structure (15, 16).

2. The revolution transport system according to claim 1, wherein the transport frame (1) comprises opposite end sections (11) formed each by a curved reversing section and at least one center section (12) disposed between the end sections (11).

3. The revolution transport system according to claim 2, wherein each end section (11) includes a curved reversing structure in the form of a semi-circular segment.

4. The revolution transport system according to claim 3, wherein the support and guide rails are formed in the area of the center section (12) of the transport frame by in each case outer carrier and guide rails (14) arranged at opposite sides of the transport frame and an inner support rail structure (15) which cooperates with both of the outer carrier and guide rails (14), the end sections being in each case formed by semi-circularly formed carrier and guide rail sections (13) and a rounded head piece disposed adjacent the respective ends of the intermediate support rail (15) of the adjacent outer section (12).

5. The revolution transport system according to claim 1, wherein the rails (13, 14, 15, 16) have all the same cross-sectional shape.

6. The revolution transport system according to claim 5, wherein all rails (13, 14, 15, 16) have the same I or T-shaped cross-section.

7. The revolution transport system according to claim 1, wherein the carriage supporting the workpiece carrier 2 on the outer carrier and guide rail (13, 14) consists of a carriage unit (21).

8. The revolution transport system according to claim 1, wherein the support rollers (24) cooperating with the inner support rail structure (15, 16) include an upper and lower support roller arrangement (24) which cooperate with upwardly and downwardly facing support surfaces of the support rail (15, 16) with at least an additional lower support roller (24) arranged at opposite sides of the upper and lower support roller arrangement.

9. The revolution transport system according to claim 1, wherein at least one counterweight is arranged on the workpiece carrier (2) in the area between the horizontally spaced support rail and carrier and guide rails.

10. The revolution transport system according to claim 1, wherein the workpiece carrier (2) includes a lifting device (23) for raising and lowering the workpiece.

* * * * *